US011603498B2

(12) United States Patent
Smith et al.

(10) Patent No.: US 11,603,498 B2
(45) Date of Patent: Mar. 14, 2023

(54) METHOD OF DECONTAMINATING A HYDROCARBON FLUID USING SONICATION

(71) Applicant: Phoenix Environmental, Inc., Plymouth, MI (US)

(72) Inventors: Davis Smith, Grand Rapids, MI (US); Casey Joe Smith, Scottsdale, AZ (US)

(73) Assignee: PHOENIX ENVIRONMENTAL, INC., Plymouth, MI (US)

( * ) Notice: Subject to any disclaimer, the term of this patent is extended or adjusted under 35 U.S.C. 154(b) by 0 days.

(21) Appl. No.: 17/201,477

(22) Filed: Mar. 15, 2021

(65) Prior Publication Data

US 2021/0292658 A1 Sep. 23, 2021

Related U.S. Application Data

(60) Provisional application No. 62/990,675, filed on Mar. 17, 2020.

(51) Int. Cl.
*C10G 31/00* (2006.01)
*C10G 31/09* (2006.01)

(52) U.S. Cl.
CPC ..... *C10G 31/00* (2013.01); *C10G 31/09* (2013.01); *C10G 2300/201* (2013.01); *C10G 2300/202* (2013.01); *C10G 2400/02* (2013.01); *C10G 2400/04* (2013.01); *C10G 2400/06* (2013.01)

(58) Field of Classification Search
CPC ..... C10G 31/00; C10G 31/09; C10G 32/00; C10G 32/02; C10G 32/04; C10G 2300/201; C10G 2300/202; C10G 2400/02; C10G 2400/04; C10G 2400/06
See application file for complete search history.

(56) References Cited

U.S. PATENT DOCUMENTS

| | | | | |
|---|---|---|---|---|
| 4,172,019 | A * | 10/1979 | Woodbridge | B01J 19/081 422/186 |
| 5,149,433 | A * | 9/1992 | Lien | F02M 37/34 210/779 |
| 5,611,993 | A | 3/1997 | Babaev | |
| 8,674,322 | B2 | 3/2014 | Kohler | |
| 8,894,273 | B2 | 11/2014 | Gordon et al. | |
| 9,034,252 | B2 | 5/2015 | Smith | |
| 9,243,477 | B2 | 1/2016 | Solenthaler | |
| 2015/0291454 | A1 | 10/2015 | McGuire | |
| 2016/0356122 | A1* | 12/2016 | Armstrong | A61L 2/025 |

OTHER PUBLICATIONS

Hulsman et al.; "Evaluation of process parameters of ultrasonic treatment of bacterial suspensions in a pilot scale water disinfection system"; Ultrasonics, Sonochemistry; 2009; pp. 1-7.

* cited by examiner

*Primary Examiner* — Prem C Singh
*Assistant Examiner* — Brandi M Doyle
(74) *Attorney, Agent, or Firm* — Cantor Colburn LLP

(57) ABSTRACT

In an aspect, a method of decontaminating a hydrocarbon fluid comprises applying an ultrasonic wave to the hydrocarbon fluid in a storage tank to maintain or reduce an amount of a microorganism in the storage tank; wherein a source of the ultrasonic wave is located within the storage tank and the storage tank has at least one of an inner volume of greater than or equal to 20 meters cubed and/or that is capable of storing 55 to 160,000 liters of the hydrocarbon fluid. In another aspect, a method of decontaminating a hydrocarbon fluid comprises applying an ultrasonic wave to the hydrocarbon fluid to disrupt a cell membrane of a microorganism to form a disrupted microorganism and to reduce a particle size of the disrupted microorganism to be less than or equal to 1.5 micrometers thereby forming a clean hydrocarbon fluid suitable for injecting through an injection nozzle.

19 Claims, No Drawings

METHOD OF DECONTAMINATING A HYDROCARBON FLUID USING SONICATION

CROSS-REFERENCE TO RELATED APPLICATION

This application claims the benefit of U.S. Provisional Patent Application Ser. No. 62/990,675 filed Mar. 17, 2020. The related application is incorporated herein in its entirety by reference.

BACKGROUND

To protect public health and the environment, the United States Environmental Protection Agency Clean Air Highway Diesel's final rule stipulated a 97% reduction in sulfur content of diesel fuel. The Tier 3 Gasoline Sulfur program that grew out of the Clean Air Act required a reduction in the sulfur content in gasoline to a maximum of 10 parts per million by weight beginning in 2017. Within one year of implementation, the Petroleum Equipment Institute received reports of severe and accelerated corrosion of metallic components of storage tanks and equipment used for transporting, dispensing, and storing ultra-low sulfur diesel. Metallic components included corrosion resistant materials such as aluminum, copper, stainless steel, galvanized steel, and more. Reports included, for example, observations of a metallic coffee ground type substance clogging the dispenser filters in addition to corrosion and/or failure of seals, gaskets, tanks, meters, leak detectors, solenoid valves, and riser pipes. Failure of such components can result in release of fuel products creating a large environmental hazard.

The presence of acetic acid or acetate in high concentration in the vapor sampled from various ultra-low sulfur diesel containing tanks, as well as the concentration of acetate in the water bottoms, suggest that acetic acid may be reacting with the iron to produce the scale and corrosion observed of the corroded equipment. As such, it is believed that the corrosion ultimately arises from increased levels of acetic acid in the ultra-low sulfur diesel, where the acetic acid is likely being produced by acetic acid producing bacteria feeding on low levels of ethanol contamination, possibly by the following reaction:

$$C_2H_5OH+O_2 \rightarrow CH_3COOH+H_2O$$

It was found that fuel comprising even as little as 0.0033 volume percent of ethanol in the presence of enough bacteria and oxygen could result in high enough amounts of acetic acid to cause extensive corrosion. Entry and interstitial bushings constructed of rubber are noted to fail in the presence of vapors and bacteria.

Acetic acid producing bacteria is likely to be the cause of the increased levels of acetic acid as bacteria of the family Acetobacteraceae was found to be present in the bottom and/or in the sediment that accumulates in, for example, the storage tanks. Bacteria of the family Acetobacteraceae, specifically of the genus *Acetobacter*, are known to metabolize ethanol into acetic acid in the presence of oxygen and water in slightly acidic conditions. It is believed that higher levels of acetic acid producing bacteria are present in ultra-low sulfur diesel as compared to low sulfur diesel due to the higher levels of sulfur functioning as a natural biocide in the low sulfur diesel.

Changing legislation is further compounding the issues with bacterial growth in gasoline as regulations have been encouraging, and in some cases mandating the use of ethanol in gasoline. These regulations have resulted in the widespread use of E10 gasoline and the advent of E15 gasoline for flex fuel vehicles. The ample amount of the ethanol and the presence of small amounts of water inherently present in the ethanol results in large bacterial populations forming biofilms on the inner walls of fuel containing devices such as tanks, pipes, etc., fatigue cracking in pipeline steels, and the increased risk of corrosion as the acetic acid can migrate out solution, collecting in the headspace of the storage tanks.

Current methods of controlling bacterial growth include reducing water content in fuel, decontaminating fuels using ultraviolet light, and addition of pesticides from multiple manufacturers. Fuels containing undetermined concentrations of pesticides are being used in internal combustion engines, boilers, and for other uses. The public is exposed to diesel emissions containing varying levels of combusted and partially combusted pesticides with known and yet to be determined health risks. Employees in the petroleum industry are routinely exposed to pesticides as part of their ordinary duties. Regulations do not require labeling petroleum containing pesticides in any amount.

A system and method for reducing the amount of acetic acid producing bacteria and other bacteria from corroding or degrading fuel quality is therefore desirable to reduce the levels of acetic acid and to ultimately reduce the amount of corrosion on equipment and degrading fuel quality.

BRIEF SUMMARY

Disclosed herein is a method of decontaminating a hydrocarbon fluid using sonication.

In an aspect, a method of decontaminating a hydrocarbon fluid comprises applying an ultrasonic wave to the hydrocarbon fluid in a storage tank to maintain or reduce an amount of a microorganism in the storage tank; wherein a source of the ultrasonic wave is located within the storage tank and the storage tank has at least one of an inner volume of greater than or equal to 20 meters cubed and/or that is capable of storing 55 to 160,000 liters of the hydrocarbon fluid.

In another aspect, a method of decontaminating a hydrocarbon fluid comprises applying an ultrasonic wave to the hydrocarbon fluid that is optionally located in a storage tank to disrupt a cell membrane of a microorganism to form a disrupted microorganism and to reduce a particle size of the disrupted microorganism to be less than or equal to 1.5 micrometers thereby forming a clean hydrocarbon fluid suitable for injecting through an injection nozzle; and optionally injecting the clean hydrocarbon fluid through the injection nozzle.

The above described and other features are exemplified by the following detailed description and claims.

DETAILED DESCRIPTION

Recent regulatory changes with regards to hydrocarbon fluids such as diesel and gasoline have mandated a reduction in the sulfur concentration. Government mandates have encouraged increases of ethanol concentrations in gasoline blends. These changes are believed to be the cause of significant increases in the levels of corrosion arising from increased populations of microorganisms that can cause degradation of fuel quality and can convert ethanol to acetic acid and other undesirable compounds. Current methods of reducing microorganism populations in storage tanks that hold large volumes, for example, 55 to 160,000 liters, or 150,000 to 155,000 liters of the hydrocarbon fluid have been shown to be difficult. For example, transmission rates of ultraviolet light through a hydrocarbon fluid are low, resulting in a somewhat ineffective reduction of the microorganisms throughout the hydrocarbon fluid.

In order to inhibit the increased growth of microorganisms and biocorrosion occurring in fuel systems, a method of decontaminating the hydrocarbon fluid using sonication was developed. It was found that applying sonication (also referred to herein as applying an ultrasonic wave) to the hydrocarbon fluid disrupted both the cellular membranes and the DNA of the microorganisms present therein, thereby reducing or eliminating the number of microorganisms in the hydrocarbon fluid. It was found that this method can be successful in reducing the number of microorganisms in large storage tanks, for example, having an inner volume of greater than or equal to 20 meters cubed, or 30 to 100 meters cubed and/or that is capable of storing 55 to 160,000 liters, or 150,000 to 155,000 liters of the hydrocarbon fluid. Decontamination with ultrasonication has additional advantages in that a source of the ultrasonic waves can be located directly in a storage tank, avoiding a need for an external decontamination unit and that it can effectively decontaminate the headspace region of the storage tank that is not in direct contact with the hydrocarbon fluid.

Moreover, it was discovered that the present method of applying sonication to the hydrocarbon fluid can be performed under sonication conditions such that the size of the microorganisms, remnants thereof, and other particulates, can be reduced to less than or equal to 1.5 micrometers, or greater than 0 to 1 micrometer. This size reduction can result in a clean hydrocarbon fluid that is free of particulates (for example, obtaining an iso code output of 18/16/13 for fuel that was initially 20/18/15).

Common injector nozzles often subject hydrocarbon fluids to pressures as high as 30,000 pounds per square inch (2.068 megapascals) in order to get good fuel efficiencies. Larger particles, those having a particle size of greater than or equal to 2 micrometers, that are present in the hydrocarbon fluid passing through such an injector nozzle can plug of the nozzle, thereby reducing or even preventing flow through the nozzle and often requiring nozzle removal and cleaning. The present method thereby allows for the clean hydrocarbon fluid to be injected through an injection nozzle, while significantly reducing the probability of injection nozzle blockages.

The method of decontaminating a hydrocarbon fluid can include applying an ultrasonic wave to the hydrocarbon fluid to maintain or reduce an amount of a microorganism in the hydrocarbon fluid. The ultrasonic wave can have an oscillating sound pressure wave that operates at a frequency of greater than or equal to 10 kilohertz, or 30 to 120 kilohertz. The ultrasonication can occur constantly or intermittently. For example, a low level of sonication, for example, 10 to 45 kilohertz, can be constantly applied to the hydrocarbon fluid. Conversely, the sonification can comprise intermittently applying the ultrasonic waves, for example, at intervals of 0.1 second to 1 week, or 1 minute to 1 day. For example, the ultrasonic waves can be applied for a sonication time of 0.1 second to 1 week, or 1 minute to 1 day and can be stopped for a stop time of 0.1 second to 1 week, or 1 minute to 1 day. The sonication time and the stop time can be the same or different and can vary depending on the levels of microorganism or contaminant level. During the sonification, the hydrocarbon fluid can be at a temperature of 10 to 50 degrees Celsius, or 10 to 30 degrees Celsius.

The sonication conditions can be selected such that not only can the number of microorganism be reduced, but also the size of destroyed microorganisms and other particles can be reduced as well. Here, the ultrasonic wave can be applied to the hydrocarbon fluid to disrupt the cell membrane of the microorganisms to form disrupted microorganisms and to further reduce a particle size of the disrupted microorganism to be less than or equal to 1.5 micrometers, or greater than 0 to 1 micrometer, or 0.001 to 0.95 micrometers thereby forming a clean hydrocarbon fluid suitable for injecting through an injection nozzle. The sonication conditions can be adjusted by those of skill in the art to ensure that the particle size of the disrupted microorganisms is in the desired range. Accordingly, the present clean hydrocarbon fluid can be used in conjunction with fluid flow through new diesel injectors that generally need any particles present in the fluid to be smaller than 2 micrometers, or smaller than 1 micrometer. As used herein, the particle size can be determined using a particle counter such as ISO 4406 and "Suggested Acceptable Contamination Codes" provided by Parker Industries. Using an optical microscope would not be sufficient.

The source of the ultrasonic waves can be located in at least one of a pipe, a location proximal to a pipe, upstream of an injection nozzle, or in a storage tank. The source of the ultrasonic waves can be located within the storage tank. For example, the storage tank can be opened, the source of the ultrasonic waves can be inserted, and the storage tank can be closed. In order to increase the exposure of the hydrocarbon fluid to the ultrasonic waves, the storage tank can comprise a mixing element such as a rotating shaft, a magnetic stirrer, or a pump (for example, internally or externally located with respect to the storage tank). In addition to, or instead of the fluid being actively mixed, the source of the ultrasonic waves can be constantly or intermittently moved around the storage tank to ensure that all of the hydrocarbon fluid is exposed. Conversely, the inherent mixing that can arise due to the application of the ultrasonic waves can be relied on.

The method of decontaminating the hydrocarbon fluid can comprise flowing a contaminated hydrocarbon fluid into a decontamination unit, ultrasonicating the hydrocarbon fluid with ultrasonic waves that are emitted from an ultrasonic wave source such that the contaminated hydrocarbon fluid becomes a more purified hydrocarbon fluid, and flowing the purified hydrocarbon fluid out of the decontamination unit; wherein a microorganism level in the purified hydrocarbon fluid is less than that of the contaminated hydrocarbon fluid.

If the hydrocarbon fluid is located in a hydrocarbon fluid transportation unit, then the method of decontamination of hydrocarbon fluid in the transportation unit can comprise applying an ultrasonic wave to a decontamination region of the hydrocarbon fluid transportation unit with an ultrasonic wave emitting source can be configured to irradiate the hydrocarbon fluid with ultrasonic waves. The decontamination region can be in the hydrocarbon fluid transportation unit or can be a separation region from the hydrocarbon fluid transportation unit.

The source of the sonication can be positioned such that the ultrasonic waves reach an inner surface of the storage tank or an inner surface of a pipe to reduce the amount of or to prevent the occurrence of biocorrosion on the inner surface. The source of the ultrasonic waves can be positioned such that the ultrasonic waves reach greater than or equal to 50 area percent, or 75 to 100 area percent, or 95 to 100 area percent of the inner surface of the storage tank or the pipe. For large storage tanks, multiple sources of the ultrasonic waves can be present in and/or proximal to the storage tank such that all of the inner surface of the storage tank is exposed to the ultrasonic waves. If multiple sources of the ultrasonic waves are present, then they can be positioned such that a frequency is established that can impart enough energy to disrupt the cellular membranes and/or DNA. The source can emit one or more frequencies. If multiple sources are present, then more than one frequency can be emitted from the respective sources to disrupt cell membranes. The frequencies of the respective sources can be selected to obtain an optimal frequency for membrane disruption. The frequencies of the respective sources can be selected to obtain a resonant frequency, for example, a first source can have a frequency of 900 to 1,300 kilohertz and a second source can have a frequency of 30 to 500 kilohertz. The ultrasonic waves can prevent the build-up of biocorrosion on the inner surface of the storage tank or the pipe.

The source of the sonication can be positioned such that the ultrasonic waves irradiate a head space of the storage tank. Positioning the source in the head space can result in a reduction in the amount of biocorrosion in the head space or can prevent the biocorrosion in the head space from occurring. The source of the ultrasonic waves can be located in the head space of the storage tank. As used herein, the head space refers to a gas filled volume in the storage tank.

The method can further include applying gamma radiation in addition to application of the ultrasonication. The gamma radiation can be applied via a constant dosage using low level sources, which can emit gamma rays at levels of 1 to 10 kilo-Gray (kGy) or intermittent dosage using higher levels of greater than or equal to 10 kGy. As used herein intermittently irradiating can comprise irradiating for a first amount of time to reduce a microorganism level to below a predetermined level; after achieving the predetermined level, stopping the irradiating for a second amount of time until a maximum microorganism level is achieved; and after achieving the maximum microorganism level, irradiating the hydrocarbon fluid. An ultraviolet (UV) light can be used in the headspace as UV light works well in air.

The method has the added benefit that the storage tank can be located underground. For example, at least 10 volume percent, or 10 to 100 volume percent of the storage tank can be located underground. 100 volume percent of the storage tank can be located underground, such that the separating material (for example, at least one of earth, concrete, brick, steel, or the like) can separate the storage tank from a ground-level surface.

The walls of the storage tank can comprise at least one of fiberglass, a composite, a plastic, or steel. If the storage tank comprises fiber glass, then the storage tank further can comprise an outer shielding layer; wherein the outer shielding layer optionally comprises at least one of a composite, a plastic, or steel. A wall thickness of the storage tank and the shielding layer can each independently be 1 to 10 centimeters, or 2 to 5 centimeters.

The hydrocarbon fluid can be filtered to remove any particulates or contaminant present in hydrocarbon fluid, for example, arising from irradiated microorganisms. The hydrocarbon fluid can be filtered by directing a stream of particulate-containing hydrocarbon fluid through a filter to form a filtered stream. The filtered stream can be redirected to the storage tank. The filter can have a pore size of less than or equal to 1 micrometer, or less than or equal to 0.5 micrometers, or 0.01 to 1 micrometers.

The hydrocarbon fluid can comprise at least one of petroleum, gasoline (for example, E10, E15, or E85), heating oil, diesel fuel (for example, biodiesel), kerosene, or jet fuel.

The source of the sonication is not particularly limited and can comprise at least one of a probe, a transducer, a horn, a fork, or a sonotrode. The sonication equipment or the source of the ultrasound can be installed to be completely surrounded by the fuel. The sonication equipment or the source of the ultrasound can be in a pipe or tube, can be mounted on the sides of a pipe or tube. The sonication equipment or the source of the ultrasound can be mounted in a vessel or intermediate step of another process such as filtration or flue transfer. The sonication equipment or the source of the ultrasound can be mounted on the exterior of a vessel to transmit the ultrasonic energy through the wall of a tank, vessel, tube, or pipe.

The microorganism can comprise at least one of a bacterium or a fungi. An example of a microorganism that utilizes hydrocarbons and can be present in the hydrocarbon fluid is *Pseudomonas aeruginosa*. Other types of microorganisms include bacteria such as *Desulfovibrio desulfuricans, Flavobacterium* species, *Micrococcus paraffivae, Mycobacterium phlei, Bacterium aliphaticum*, etc., and fungi such as *Cladosporium, Nocardia, Aspergillus, Candida lipolytica, Penicillium*, etc. The microorganism can comprise a lactic acid bacterium capable of converting an alcohol, such as ethanol, to an organic acid, such as lactic acid or acetic acid. Examples of lactic acid bacteria include those in the *Lactobacillus* species, those in the *Pediococcus* species, *Acetobacter* species, or wild yeast.

Treatment of hydrocarbon fluid can kill greater than or equal to 90 weight percent of the microorganisms in the contaminated hydrocarbon fluid, or greater than or equal to 95 weight percent, or 99 to 99.99 weight percent based on the total weight of the microorganisms present prior to exposure to the sonication.

Set forth below are various combinable aspects of the present disclosure.

A method of decontaminating a hydrocarbon fluid can comprise applying an ultrasonic wave to the hydrocarbon fluid in a storage tank to maintain or reduce an amount of a microorganism in the storage tank. A source of the ultrasonic wave can be located within the storage tank and the storage tank can have at least one of an inner volume of greater than or equal to 20 meters cubed and/or that is capable of storing 55 to 160,000 liters of the hydrocarbon fluid. A method of decontaminating a hydrocarbon fluid can comprise applying an ultrasonic wave to the hydrocarbon fluid that is optionally located in a storage tank to disrupt a cell membrane of a microorganism to form a disrupted microorganism and to reduce a particle size of the disrupted microorganism to be less than or equal to 1.5 micrometers thereby forming a clean hydrocarbon fluid suitable for injecting through an injection nozzle. The method can further comprise injecting the clean hydrocarbon fluid through the injection nozzle. The method can comprise the injecting the clean hydrocarbon fluid through the injection nozzle.

The applying the ultrasonic wave can occur at a location that is in fluid communication with and that is upstream of the injection nozzle. A frequency of the ultrasonic wave can be modulated to match a resonance frequency of a cell membrane of the microorganism. The method can further comprise mixing the hydrocarbon fluid in the storage tank during the applying the ultrasonic wave. The ultrasonic wave can be directed to an inner surface of the storage tank thereby reducing the biocorrosion on the inner surface or preventing the biocorrosion from forming on the inner surface. The ultrasonic wave can be directed to the inner surface optionally by a probe inserted in the fuel, a sonotrode attached to the inside or outside of the tank, or by transferring the ultrasonic frequency into the fuel and/or headspace. The applying the ultrasonic wave can comprise irradiating a head space of the storage tank, thereby reducing the biocorrosion on the inner surface or preventing the biocorrosion in the head space. The applying the ultrasonic wave can comprise applying a constant ultrasonic wave. The applying the ultrasonic wave can comprise intermittently applying the ultrasonic wave. The applying the ultrasonic wave can comprise applying more than one frequency of the ultrasonic wave simultaneously.

At least 10 volume percent, or 10 to 100 volume percent, or 100 volume percent of the storage tank can be located underground. The storage tank can have an inner volume of 30 to 100 meters cubed. The storage tank can be capable of storing 150,000 to 155,000 liters of the hydrocarbon fluid. The storage tank can comprise at least one of fiberglass, a composite, a plastic, or steel. The storage tank can comprise fiberglass. The storage tank can comprise an outer shielding layer. The outer shielding layer can comprise at least one of a composite, a plastic, or steel.

The method can further comprise filtering the hydrocarbon fluid. The hydrocarbon fluid comprises at least one of petroleum, gasoline (for example, E10, E15, or E85), heating oil, diesel fuel (for example, biodiesel). The hydrocarbon fluid can comprise less than or equal to 15 parts per million by weight of sulfur. The hydrocarbon fluid can comprise greater than or equal to 10 volume percent of ethanol based on the total volume of the hydrocarbon fluid.

The applying the ultrasonic wave can comprise removing an amount of fluid from the storage tank; applying the ultrasonic wave to the amount of fluid; and returning the amount of fluid to the storage tank after applying the ultrasonic wave. The applying the ultrasonic wave can comprise removing an amount of fluid from the storage tank; applying the ultrasonic wave to the amount of fluid; and directing the amount of fluid away from the storage tank, optionally to a different storage tank, to a pipeline, to an engine, to an injector nozzle, or to a boiler.

The microorganism can comprise at least one of a bacteria of the family Acetobacteraceae, a bacteria of the family Lactobacillaceae, or a fungi of the family Saccharomycetaceae.

The compositions, methods, and articles can alternatively comprise, consist of, or consist essentially of, any appropriate materials, steps, or components herein disclosed. The compositions, methods, and articles can additionally, or alternatively, be formulated so as to be devoid, or substantially free, of any materials (or species), steps, or components, that are otherwise not necessary to the achievement of the function or objectives of the compositions, methods, and articles.

The terms "a" and "an" do not denote a limitation of quantity, but rather denote the presence of at least one of the referenced item. The term "or" means "and/or" unless clearly indicated otherwise by context. Reference throughout the specification to "an aspect", "an embodiment", "another embodiment", "some embodiments", and so forth, means that a particular element (e.g., feature, structure, step, or characteristic) described in connection with the embodiment is included in at least one embodiment described herein, and may or may not be present in other embodiments. In addition, it is to be understood that the described elements may be combined in any suitable manner in the various embodiments.

The endpoints of all ranges directed to the same component or property are inclusive of the endpoints, are independently combinable, and include all intermediate points and ranges. For example, ranges of "up to 25 volume percent, or 5 to 20 volume percent" is inclusive of the endpoints and all intermediate values of the ranges of "5 to 25 volume percent," such as 10 to 23 volume percent, etc.

The term "combination" is inclusive of blends, mixtures, alloys, reaction products, and the like. Also, "combinations comprising at least one of the foregoing" means that the list is inclusive of each element individually, as well as combinations of two or more elements of the list, and combinations of at least one element of the list with like elements not named Unless defined otherwise, technical and scientific terms used herein have the same meaning as is commonly understood by one of skill in the art to which this disclosure belongs.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A method of decontaminating a hydrocarbon fluid comprising:

applying a first frequency and a second frequency of an ultrasonic wave simultaneously to the hydrocarbon fluid that is located in a storage tank to disrupt a cell membrane of a microorganism to form a disrupted microorganism and to reduce a particle size of the disrupted microorganism to be less than or equal to 1.5 micrometers thereby forming a clean hydrocarbon fluid suitable for injecting through an injection nozzle;

filtering the clean hydrocarbon fluid through a filter having a pore size of less than or equal to 1 micrometer; and injecting the clean hydrocarbon fluid through the injection nozzle;

wherein the hydrocarbon fluid is at least one of petroleum, gasoline, heating oil, diesel fuel, kerosene, or jet fuel;

wherein the first frequency is 900 to 1,300 kilohertz and the second frequency is 30 to 500 kilohertz.

2. The method of claim 1, wherein the applying the first frequency and a second frequency of the ultrasonic wave occurs at a location that is in fluid communication with and that is upstream of the injection nozzle.

3. The method of claim 1, wherein at least one of the first frequency or the second frequency of the ultrasonic wave is modulated to match a resonance frequency of a cell membrane of the microorganism.

4. The method of claim 1, wherein the applying the first frequency and a second frequency of the ultrasonic wave to the hydrocarbon fluid occurs in the storage tank; wherein the storage tank has at least one of an inner volume of greater than or equal to 20 meters cubed and/or that is capable of storing 55 to 160,000 liters of the hydrocarbon fluid; and wherein the storage tank comprises fiberglass and wherein the storage tank has an outer shielding layer located thereon; wherein the outer shielding layer comprises at least one of a composite, a plastic, or steel.

5. The method of claim 1, wherein the microorganism comprises at least one of a bacteria of the family Acetobacteraceae.

6. The method of claim 1, wherein the method further comprises applying gamma radiation to the hydrocarbon fluid that is located in the storage tank.

7. A method of decontaminating a hydrocarbon fluid comprising:

applying a first frequency and a second frequency of an ultrasonic wave to the hydrocarbon fluid that is optionally located in a storage tank to disrupt a cell membrane of a microorganism to form a disrupted microorganism and to reduce a particle size of the disrupted microorganism to be less than or equal to 1.5 micrometers thereby forming a clean hydrocarbon fluid suitable for injecting through an injection nozzle; wherein a frequency of the ultrasonic wave is modulated to match a resonance frequency of a cell membrane of the microorganism; and injecting the clean hydrocarbon fluid through the injection nozzle;

wherein the hydrocarbon fluid comprises at least one of gasoline or diesel fuel;

wherein the diesel fuel comprises less than or equal to 15 parts per million by weight of sulfur; and wherein the gasoline comprises greater than or equal to 10 volume percent of ethanol based on the total volume of the hydrocarbon fluid; and wherein the microorganism comprises at least one of a bacteria of the family Acetobacteraceae or a bacteria of the family Lactobacillaceae; and wherein the first frequency is 900 to 1,300 kilohertz and the second frequency is 30 to 500 kilohertz.

8. The method of claim 7, further comprising filtering the hydrocarbon fluid.

9. A method of decontaminating a hydrocarbon fluid comprising:

applying a first frequency and a second frequency of an ultrasonic wave simultaneously to the hydrocarbon fluid in a storage tank to maintain or reduce an amount of a microorganism in the storage tank and to reduce a particle size of the disrupted microorganism to be less than or equal to 1.5 micrometers thereby forming a clean hydrocarbon fluid suitable for injecting through an injection nozzle;

wherein a source of the ultrasonic wave is located within the storage tank and the storage tank has at least one of an inner volume of greater than or equal to 20 meters cubed and/or that is capable of storing 55 to 160,000 liters of the hydrocarbon fluid; and wherein the first frequency is 900 to 1,300 kilohertz and the second frequency is 30 to 500 kilohertz.

10. The method of claim 9, further comprising mixing the hydrocarbon fluid in the storage tank during the applying.

11. The method of claim 9, wherein the first frequency and a second frequency of the ultrasonic wave are directed to an inner surface of the storage tank thereby reducing the biocorrosion on the inner surface or preventing the biocorrosion from forming on the inner surface; wherein the first frequency and the second frequency of the ultrasonic wave are directed to the inner surface optionally by a probe inserted in the fuel, a sonotrode attached to the inside or outside of the tank, or by transferring the ultrasonic frequency into the fuel and/or headspace.

12. The method of claim 9, wherein the applying the first frequency and a second frequency of the ultrasonic wave comprises irradiating a head space of the storage tank, thereby reducing the biocorrosion on the inner surface or preventing the biocorrosion in the head space.

13. The method of claim 9, wherein 10 to 100 volume percent of the storage tank is located underground.

14. The method of claim 9, wherein the storage tank has an inner volume of 30 to 100 meters cubed; and/or wherein the storage tank is capable of storing 150,000 to 155,000 liters of the hydrocarbon fluid; and/or wherein the storage tank comprises at least one of fiberglass, a composite, a plastic, or steel.

15. The method of claim 9, wherein the applying the first frequency and a second frequency of the ultrasonic wave comprises removing an amount of fluid from the storage tank; applying the first frequency and the second frequency of the ultrasonic wave to the amount of fluid; and returning the amount of fluid to the storage tank after applying the first frequency and a second frequency of the ultrasonic wave.

16. The method of claim 9, wherein the hydrocarbon fluid comprises at least one of petroleum, gasoline, heating oil, diesel fuel, kerosene, or jet fuel; and wherein the hydrocarbon fluid comprises at least one of less than or equal to 15 parts per million by weight of sulfur; or greater than or equal to 10 volume percent of ethanol based on the total volume of the hydrocarbon fluid.

17. The method of claim 9, wherein the microorganism comprises at least one of a bacteria of the family Acetobacteraceae, a bacteria of the family Lactobacillaceae, or a fungi of the family Saccharomycetaceae.

18. The method of claim 9, wherein the storage tank comprises fiberglass and wherein the storage tank has an outer shielding layer located thereon; wherein the outer shielding layer comprises at least one of a composite, a plastic, or steel.

19. The method of claim 9, wherein the method comprises the injecting the clean hydrocarbon fluid through the injection nozzle.

* * * * *